United States Patent [19]

Wiese

[11] 4,114,786

[45] Sep. 19, 1978

[54] GARMENT HANGER

[76] Inventor: Harold Wiese, North Highland, Box 236, Madison, S. Dak. 57042

[21] Appl. No.: 821,513

[22] Filed: Aug. 3, 1977

[51] Int. Cl.[2] ..... A47J 51/11

[52] U.S. Cl. ..... 223/94

[58] Field of Search ..... 223/94, 89, 85

[56] References Cited

U.S. PATENT DOCUMENTS

| | | | |
|---|---|---|---|
| 959,687 | 5/1910 | Altermatt | 223/94 |
| 1,286,022 | 11/1918 | Klesat | 223/94 |
| 2,290,722 | 7/1942 | Weingarten | 223/94 |
| 2,509,754 | 5/1950 | Badalamenti | 223/94 |
| 3,858,770 | 1/1975 | Murray | 223/94 |

FOREIGN PATENT DOCUMENTS

| | | | |
|---|---|---|---|
| 812,821 | 9/1951 | Fed. Rep. of Germany | 223/92 |

*Primary Examiner*—George H. Krizmanich

[57] ABSTRACT

A garment hanger having a body member and a pair of side arms pivotally attached to the body member, a vertical stem and pair of links each link being pivotally attached at one end to the lower end of the stem with one link having its other end pivotally attached to a mid-point on one of the arms and the other of the links having its other end pivotally attached to a mid-point on the other of the pair of arms, the stem being vertically movable with respect to the body member to bring the lower pivot point of the stem to a position above a straight line drawn between the median pivot points on the arms and against a stop, in which position the arms are locked against movement downwardly about their pivot points.

9 Claims, 2 Drawing Figures

GARMENT HANGER

This invention relates to a garment hanger and more particularly to a garment hanger which is foldable into compact form.

BACKGROUND OF THE INVENTION

It would also be desirable to have such a collapsible hanger which could be put into a garment when it is in collapsed form and then conveniently expanded to fit the garment, or which when it is in expanded form suspending a garment could be conveniently collapsed so as to be easily removed from the garment. Such a hanger would be particularly helpful where garments are being transported in vans or in mobile homes where space is at a premium and there is frequent jostling which tends to dislodge the garments from their hangers.

Accordingly, I have set about to provide such a hanger.

Figure 1:
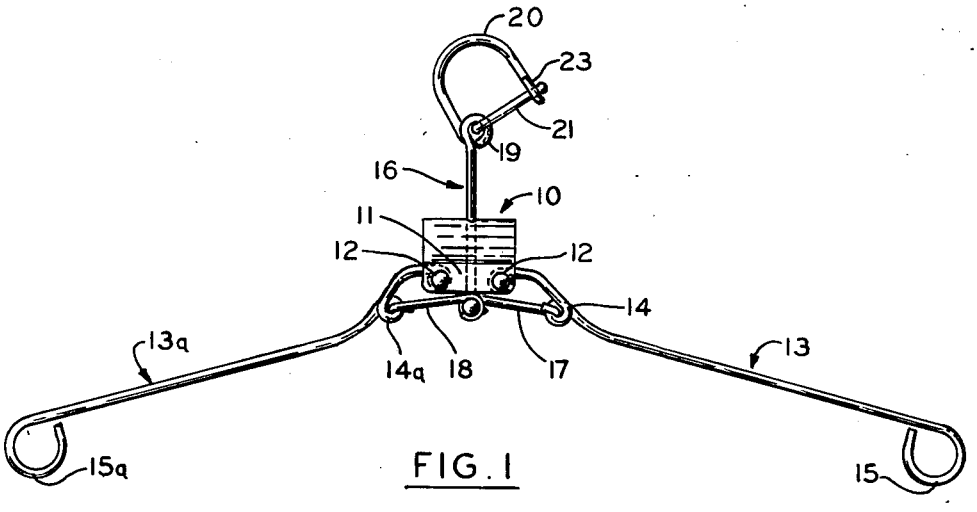
Figure 2:
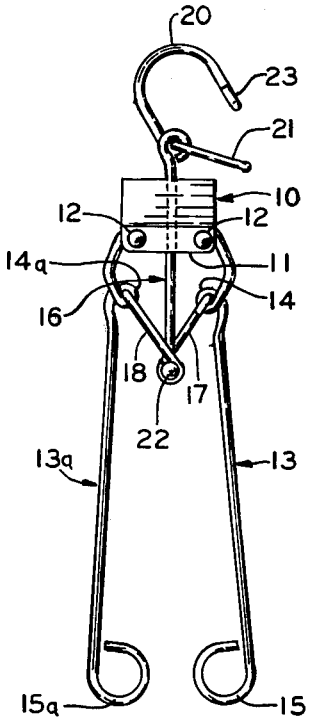

One embodiment of my invention is illustrated in the accompanying drawing in which FIG. 1 is a view of the improved hanger with the arms in outstretched position, and FIG. 2 is a view like FIG. 1 but with the hanger in collapsed position.

As illustrated, the improved hanger has a body member 10, which, in the illustrated embodiment is made from a band or strip with an opening near its center and being turned to bring its end portions 11 toward each other. A pair of bolts or pins 12 extend through these end portions to hold them in place. As will later appear more clearly, these same pins may serve to attach the arms to the body portion.

The arms 13 and 13*a* may be identical except that one extends to the left and one extends to the right of body 10. The arm 13 has its inner end formed into a loop. This looped arm end extends between the end portions 11 of the body and about a pin 12. Arm 13 also is turned to form a loop 14 at a point spaced from the point of pivotal attachment of this arm to the body member and at its outer end arm 13 is turned to form the loop 15 which rounds off the outer end of the arms so that it will not damage garments hung on the hanger. Arm 13*a* is constructed like arm 13 being pivotally attached to the body 10 through the use of a looped arm end and the other of pins 12. Arm 13*a* also has the loop 14*a* and the outer end loop 15*a*. Preferably, the loops 14 and 14*a* are at an equal distance from the pivoted inner end of arms 13 and 13*a*.

As illustrated the arms 13 and 13*a* are made of a heavy wire which is formed into a loop at the points of pivotal attachment. These arms may also be formed of wood or plastic material and in this case no loops need be formed and holes may be drilled or formed by molding in the wood or plastic material at the pivot points. Where holes are so provided pins may extend through these holes to pivotally attach the inner end of the arms with the body 10 and to pivotally attach the links at a mid-point on each arm.

The stem 16 extends vertically down through the opening in the body and at the lower end is pivotally attached to the one end of each of links 17 and 18. The other end of link 17 engages the loop 14 so as to be pivotally attached to arm 13 at the position of loop 14 and the other end of link 18 engages the loop 14*a* so as to be pivotally attached to arm 13*a* at the position of loop 14*a*.

The top part of stem 16 is turned to form the loop 19 and the upper end portion is turned to form the hook 20, and the extreme end portion of hook 19*a* is turned into U-shaped form. The tongue 21 is pivotally engaged at its one end with loop 19 and is adapted at its other end to fit down into the U-shaped portion 23 at the end of the hook. Preferably, the tongue and/or the end portion of the hook may be coated with an abrasive or resilient material such as rubber so that the tongue will not be accidentally dislodged from position but can be removed at will.

The stem 16 is slideable in the body member 10 and may be moved downwardly or upwardly of the body member. When it is at its extreme upward position as shown in FIG. 1, the lower pivot pin 22 which joins the inner ends of links 17 and 18, is above a straight line between the pivot points of the outer ends of these links and rests against the body member 10. This provides a stop which prevents the stem from moving to a higher position with respect to the body 10. Preferably, the links 17 and 18 are of equal length so as to make the arms symmetrical and to center the stem.

When the stem is moved upwardly with respect to the body member 10 so that its lower pivot point is above a straight line joining the pivoted attachment of the links to the arms and rests against the stop, the arms are locked in their raised position and they cannot move downwardly or be moved downwardly about their pivoted attachment to the body until the stem is first moved downwardly with respect to the body 10 to move its point of pivoted attachment to the links below the line above mentioned. Further downward movement of the stem with respect to the body does bring the arms downwardly and inwardly toward each other to bring the hanger into its collapsed form as shown in FIG. 2.

The device may be moved into its regular form in which arms are in their upward outstretched position from the collapsed form of FIG. 2 by simply moving the stem upward with respect to the body. As above explained, this expands the arms and brings them into locked condition and they stay in locked condition until the stem is again moved down with respect to the body.

The hanger may be stored in collapsed condition and when it is to be utilized to support a garment, it may be placed in collapsed condition into a coat or dress. The person operating the hanger may then grasp the body 10 with one hand and the stem or hook with the other hand and move the hook away from the body or the body away from the hook to expand the arms and to fit the garment. At the end of the stroke the hanger will be locked in this condition.

Likewise, when the hanger is to be removed from the garment, the body 10 may be grasped by one hand and the stem 16 or hook 20 may be grasped by the other hand, and by moving the stem or hook toward the body or the body toward the stem or hook, the hanger collapses and may be easily removed from the garment.

Attention is called to the drawing in which the link 17 is shown on the backside of stem 16 and has its outer end turned forwardly and extending forwardly through the opening in the loop 14, while link 18 is on the front side of stem 16 and has its outer end turned rearwardly and extending rearwardly through the opening in loop 14*a*. Thus, the shank of link 17 (the part between the turned ends) extends on the backside of the stem 16 while the shank of link 18 extends on the front side of stem 16, whereby when the stem is moved upwardly or downwardly the shanks of the links move in planes which are free of the stem.

When the hanger is to be used in supporting a garment and is hung, for example, on a rod in a closet, the hook may be placed over the closet rod and the tongue 21 then placed in the U-shaped portion 23 to hold the hanger against dislodgement from the rod. The arrangement including tongue 21 is more especially important when the garment is to be hung in a van or a mobile home.

Although only one embodiment of the invention has been illustrated and described in detail, it will be apparent to those skilled in the art that many embodiments may be constructed and many changes may be made, all within the spirit of the invention, and all such changes and embodiments are to be considered within the scope of the appended claims.

What is claimed is:

1. A garment hanger comprising a body member, a pair of arms each of which is pivotally attached at its one end to said body member, one of said arms extending to one side of said member and the other of said arms extending to the other side of said member, a vertical stem extending downwardly and being slideably engaged with said member, a pair of links one of which is pivotally attached at its one end with one of said arms at a point spaced from the pivoted end of said one arm and having its other end pivotally attached to the lower end of said stem and the other of said pair of links having its one end pivotally attached to the other of said arms at a point spaced from the pivoted end of said other arm and having its other end pivotally attached to the lower end of said stem, whereby when said stem is moved downwardly of said member said links operate to bring said arms downwardly and toward each other and when said stem is moved upwardly of said member said arms are moved upwardly away from each other, said stem being movable upwardly of said member beyond a straight line between the points of pivotal attachment of said links with said arms, and stop means for limiting further upward movement of the lower end of said stem after said stem has been moved upwardly to a predetermined position above said line, whereby when said stem is in said predetermined position, said arms are locked against downward movement about their pivots, one of said links having its shank rearward of said stem and the other of said links having its shank forward of said stem.

2. A garment hanger as set forth in claim 1 in which said body member is a band which is turned to form a loop, and means which includes a pair of pins extending through the edge portions of said band for pivotally attaching said arms to said body member and for securing said edge portions of said band to each other.

3. A garment hanger as set forth in claim 2 in which the inner end portions of said arms contain holes therein and which includes pins extending through said body and said holes in the end portions of the arms to thereby pivotally attach each of said arms to said body.

4. A garment hanger as set forth in claim 2 in which said band has an opening in its middle portion and said stem extends through said opening.

5. A garment hanger as set forth in claim 1 which includes a hook at the upper end of said stem and in which the end of said hook is turned laterally of the plane of the hook into U-shaped configuration and which includes a tongue pivotally attached at its one end to said stem below said hook and being adapted to engage said hook at said U-shaped configuration.

6. A garment hanger as set forth in claim 5 in which said stem is turned to form a loop and said one end of said tongue engages said stem loop.

7. A garment hanger as set forth in claim 2 wherein said stop means includes a member which is attached to said stem and which is positioned to strike said body when said stem has been raised to bring the point of pivotal attachment of said stem with said links to a position above said line.

8. A garment hanger as set forth in claim 1 in which said arms each have an opening therein and in which the outer end portion of one of said links extends forwardly through the opening of one of said arms and the outer end portion of the other of said links extends rearwardly through the opening in the other of said arms.

9. A garment hanger as set forth in claim 8 in which said one link has its other end pivotally attached to said stem on the rearward side of said stem and said other link has its other end pivotally attached to said stem on the forward side of said stem.

* * * * *